US009286874B1

(12) United States Patent
Micek

(10) Patent No.: US 9,286,874 B1
(45) Date of Patent: Mar. 15, 2016

(54) BLEND AND CONFIGURATION CONTROL FOR A STRING INSTRUMENT

(71) Applicant: Petr Micek, Baltimore, MD (US)

(72) Inventor: Petr Micek, Baltimore, MD (US)

( * ) Notice: Subject to any disclaimer, the term of this patent is extended or adjusted under 35 U.S.C. 154(b) by 0 days.

(21) Appl. No.: 14/588,599

(22) Filed: Jan. 2, 2015

(51) Int. Cl.
*G10H 3/18* (2006.01)
*G10H 3/14* (2006.01)
*G10H 3/12* (2006.01)

(52) U.S. Cl.
CPC ..... *G10H 3/182* (2013.01); *G10H 3/12* (2013.01); *G10H 3/14* (2013.01); *G10H 3/18* (2013.01); *G10H 3/181* (2013.01); *G10H 3/186* (2013.01); *G10H 2220/505* (2013.01)

(58) Field of Classification Search
USPC ..... 84/726
IPC ..... G10H 3/12,3/14, 3/18, 3/182, 3/186
See application file for complete search history.

(56) References Cited

U.S. PATENT DOCUMENTS 2,784,631 A * 3/1957 Fender ..... G10H 3/182 84/726
2,817,261 A * 12/1957 Fender ..... G10H 3/182 84/728
3,544,696 A 12/1970 Broussard
3,915,048 A 10/1975 Stich
4,164,163 A 8/1979 Rhodes
4,319,510 A 3/1982 Fender
4,480,520 A * 11/1984 Gold ..... G10H 3/182 84/735
4,499,809 A * 2/1985 Clevinger ..... G10H 3/182 84/726
4,524,667 A * 6/1985 Duncan ..... G10H 3/181 84/728
5,007,324 A * 4/1991 DeMichele ..... G10H 1/0058 84/477 R
5,136,918 A * 8/1992 Riboloff ..... G10H 3/18 84/723
5,321,201 A 6/1994 Noreen
5,557,058 A * 9/1996 Lace ..... H01C 10/34 338/73
5,780,760 A * 7/1998 Riboloff ..... G10H 3/182 84/726
6,111,961 A * 8/2000 Hedrick ..... G10H 3/186 381/120
6,121,537 A * 9/2000 Pawar ..... G10H 3/182 84/728
6,998,529 B2 2/2006 Wnorowski
7,276,657 B2 10/2007 Bro et al.
7,304,232 B1 * 12/2007 Nicholes ..... G10H 1/46 84/741
7,601,908 B2 10/2009 Ambrosino (Continued)

FOREIGN PATENT DOCUMENTS

GB 2462378 A 2/2010

OTHER PUBLICATIONS

Bours Model PDB182-GTRB viewed online at http://www.bourns.com/data/global/pdfs/Bourns_PDB182_Blend-Balance_Guitar_Pots_AppNote.pdf.*

(Continued)

*Primary Examiner* — David Warren
(74) *Attorney, Agent, or Firm* — Rosenberg, Klein & Lee

(57) ABSTRACT

A blend and configuration control for a string instrument connects to a pair of pickup sensors located on the string instrument and in one arrangement includes a pair of potentiometers mechanically coupled for concurrent mechanical travel to provide individual pickup sensor output selection and parallel blending of the outputs of the two sensors. A switch is also included to immediately and reversibly provide a series configuration of the two pickup sensors. In another arrangement, the blend and configuration control includes a pair of potentiometers mechanically coupled for concurrent mechanical travel to provide individual pickup sensor output selection, a series configuration of the two pickup sensors and series blending of the two pickup sensors.

17 Claims, 12 Drawing Sheets

(56) References Cited

U.S. PATENT DOCUMENTS

| | | | | |
|---|---|---|---|---|
| 7,999,171 | B1 * | 8/2011 | Hamilton | G10H 3/182 84/727 |
| 8,704,074 | B1 | 4/2014 | Liu | |
| 8,704,075 | B2 | 4/2014 | Gournis | |
| 8,940,993 | B1 * | 1/2015 | Micek | G10H 3/18 84/725 |
| 9,153,218 | B1 * | 10/2015 | Micek | G10H 1/06 |
| 2002/0073830 | A1 * | 6/2002 | Petherick | G10H 3/181 84/726 |
| 2005/0040022 | A1 * | 2/2005 | Turner | G10H 3/182 200/538 |
| 2005/0211081 | A1 * | 9/2005 | Bro et al. | G10H 1/18 84/737 |
| 2006/0156912 | A1 | 7/2006 | Annis et al. | |
| 2007/0251374 | A1 * | 11/2007 | Armstrong-Muntner | G10H 3/182 84/735 |
| 2009/0308233 | A1 * | 12/2009 | Jacob | G10H 1/18 84/726 |
| 2010/0208916 | A1 * | 8/2010 | Jacob | G10H 3/186 381/104 |
| 2011/0290099 | A1 * | 12/2011 | Franklin | G10H 3/182 84/733 |
| 2012/0036983 | A1 * | 2/2012 | Ambrosino | G10H 3/143 84/731 |
| 2013/0327202 | A1 * | 12/2013 | Mills | G10H 3/181 84/726 |
| 2014/0013930 | A1 * | 1/2014 | Dahl | G10H 3/143 84/730 |
| 2014/0041514 | A1 * | 2/2014 | Gross | G10H 3/181 84/726 |
| 2014/0150630 | A1 * | 6/2014 | Juszkiewicz | G10H 1/44 84/626 |
| 2014/0290469 | A1 * | 10/2014 | Michaud | G10H 1/0091 84/741 |
| 2015/0107444 | A1 * | 4/2015 | Pezeshkian | G10D 1/08 84/645 |

OTHER PUBLICATIONS

Hot Rod Superblend P90 Spectrum DX X140, the Elecra Guitar Page, The Electra Forums, Nov. 22-Dec. 10, 2004. Internet web address: http://www.rivercityamps.com/electraforum/viewtopic.php?f=26&t=1709.

* cited by examiner

BLEND AND CONFIGURATION CONTROL FOR A STRING INSTRUMENT

BACKGROUND OF THE INVENTION

This disclosure directs itself, in one arrangement, to a blend and configuration control for use with a string instrument having pickup transducers and permits blending the output of a parallel configuration of a pair, or pairs, of pickup transducers and reversibly switching between parallel and series configurations without disturbing the blend setting of the parallel configuration. Further, the blend and configuration control for a string instrument provides parallel blending of the output of a pair of pickup transducers that ranges from selection of the output of one of the pickup transducers alone, through a mix of output levels of the two pickup transducers, to selection of the output of the other of the pickup transducers alone. More in particular, the disclosure is directed to a blend and configuration control for a string instrument that includes a pair of pickup transducers disposed on the string instrument for producing voltages responsive to vibration of at least one string of the string instrument and a pair of potentiometers that are coupled thereto for blending the output of the pickup transducers while in a parallel configuration and a switch for simply and instantaneously switching the configuration of the pickup transducers to a series configuration.

In another arrangement, this disclosure is directed to a blend and configuration control for a string instrument having pickup transducers that permits blending the output of a series configuration of the pickup transducers and switching between one or the other of a pair or pairs of the pickup transducers. In the other arrangement, the pair of potentiometers are coupled to a pair of output terminals and respectively to the pickup transducers, while the displaceable contacts of the potentiometers are electrically connected together for selective operative coupling of the pickup transducers in series between the output terminals, or one of the pickup transducers coupled to the output terminals, responsive to a position of the displaceable contacts of the pair of potentiometers, or the other of the pickup transducers coupled to the output terminals, responsive to another position of the displaceable contacts of the pair of potentiometers.

Electric string instruments, such as electric guitars, electric bases, electric violins, etc., use at least one pickup transducer to convert the vibration of instrument's strings into electrical impulses. The most commonly used pickups use the principle of direct electromagnetic induction. The signal generated by the pickup is of insufficient strength to directly drive an audio transducer, such as a loudspeaker, so it must be amplified prior to being input to the audio transducer.

Because of their natural inductive qualities, all magnetic pickups tend to pick up ambient electromagnetic interference (EMI) from electrical power wiring in the vicinity, such as the wiring in a building. The EMI from a 50 or 60 Hz power system can result in a noticeable "hum" in the amplified audio output from the audio transducer, particularly with poorly shielded single-coil pickups. Double-coil "Humbucker" pickups were invented as a way to overcoming the problem of unwanted ambient hum sounds. Humbucker pickups have two coils arranged to be of opposite magnetic and electric polarity so as to produce a differential signal. As ambient electromagnetic noise affects both coils equally and since they are poled oppositely, the noise signals induced in the two coils are cancelled out. The two coils of a Humbucker are often wired in series to give a fuller and stronger sound.

It is very common to utilize a pair of pickup transducers on a modern electric string instrument, one located in proximity to the bridge of the instrument and the other in proximity to the neck of the instrument. While most single coil pickups are wired in parallel with each other, it is also possible to wire them in series, producing a fuller and stronger sound. The two coils of a Humbucker type pickup can be connected in parallel as well. This results in a brighter sound, since it passes higher frequency components of the sound that would otherwise be suppressed in the series arrangement, but it is at the cost of a lower output voltage, as with a single-coil pickup. However, in the parallel configuration, the pickup's hum-cancelling properties are still retained. Using a multiple pole, multiple throw switch, such as a double pole, double throw switch (DPDT) or double pole three position switch, it is known in the art to switch the coil configuration between series and parallel, and may also provide for a "coil cut" configuration (a single coil output).

Blend potentiometers, usually formed by two potentiometers ganged together to be rotated by a single shaft, allow blending together outputs of two pickup coils in varying degrees, not unlike a balance control provided in stereo equipment. Blend potentiometers, however, do not typically accomplish switching of the coil configuration. In one known prior art system disclosed in U.S. Pat. No. 4,423,654, a tone control formed with a pair of ganged rheostats is connected to the two coils of a Humbucker type pickup. The operation of this tone control provides a series coil configuration at one end of the rotation of the control and a parallel configuration at the opposing end of the rotation thereof. Of the two rheostats used, the resistance element of one is configured to have substantially zero resistance (zero ohms) between one end terminal and the midpoint of the resistance element's length and thereafter increase linearly, while the other rheostat has a resistance that increases logarithmically along its length. Due to the logarithmic taper of the resistance element, from the one end of the travel of the control that provides a series configuration of the coils to and including the midpoint thereof, the series configuration is maintained, changing only the high frequency attenuation included in the control.

Thus, there is a need for a blend and configuration control that provides a parallel blend, series selectable configuration control for use by a musician. A need for the ability of the musician to select the output of either the neck pickup transducer or bridge pickup transducer alone, while in the parallel configuration. Also, a need for the ability of the musician to leave the knob of the blend potentiometers at any selected parallel blending of the outputs of the neck and bridge pickup transducers and simply, and instantaneously switch to the completely different configuration of the two pickup transducers in series. Thus, with one touch of the switch the musician is able to change the volume and sound of the instrument. The higher voltage produced by the series configuration has the effect of providing increased volume. If the type of pickup transducers utilizes electromagnetic induction to sense the vibration of the instrument's strings, then the pickups have coils that offer higher impedance to higher frequencies than to lower frequencies. Hence coupling the pickup coils in series has the effect of lowering the voltages of the high frequency components of the sound, providing a more mellow sound output while at the same time increasing the volume of the overall sound output.

There is also a need for a blend and configuration control that provides a series blending of the output of a pair of the neck and bridge pickup transducers, where one or the other can dominate, yet allow the musician to select the output of either the neck pickup transducer or bridge pickup transducer alone.

SUMMARY OF THE INVENTION

A blend and configuration control for a string instrument having a pair of pickup transducers is provided. The control includes a switch having multiple poles coupled to the pair of pickup transducers. The blend and configuration control further includes a pair of potentiometers where each potentiometer is coupled to the switch. Each of the pair of potentiometers has a displaceable contact. The pair of potentiometers are mechanically coupled to one another for concurrent mechanical travel of the displaceable contacts thereof. The pair of potentiometers provide selective operative coupling of (a) the pair of pickup transducers coupled in parallel to a pair of output terminals, or (b) a range of blended output of the pair of pickup transducers to the output terminals varying from output of one of the pair of pickup transducers to output of the other of the pair of pickup transducers, responsive to a position of the displaceable contacts. The selected operative coupling by the pair of potentiometers is reversibly changed to a series configuration of the pair of pickup transducers responsive to operation of the switch.

From another aspect, a blend and configuration control for a string instrument having a pair of pickup transducers is provided. The blend and configuration control includes a pair of potentiometers each having a displaceable contact. The pair of potentiometers are mechanically coupled to each other for concurrent mechanical travel of the displaceable contacts thereof, The pair of potentiometers are coupled to a pair of output terminals and each of the potentiometers is electrically connected to a respective one of the pair of pickup transducers, The pair of potentiometers provide selective operative coupling of (a) only one of the pair of pickup transducers to the output terminals, or (b) only the other of the pair of pickup transducers to the output terminals, or (c) the pair of pickup transducers coupled in series to the output terminals, or (d) a blend of the output of the pair of pickup transducers coupled in series, responsive to a position of the displaceable contacts.

DETAILED DESCRIPTION OF THE PREFERRED EMBODIMENTS

Figure 1A:
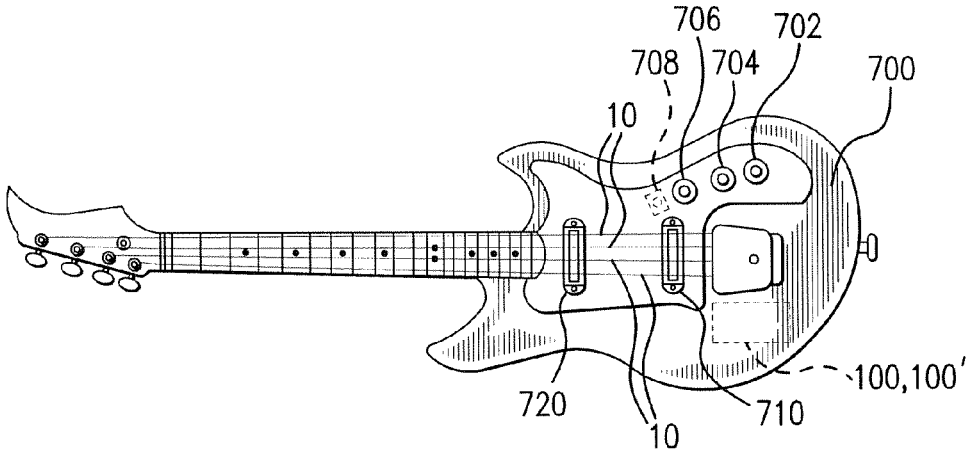
FIG. 1A is an illustration of an electric string instrument incorporating the blend and configuration control of the present invention and showing typical locations of pickup transducers for sensing string vibrations.

Referring to FIGS. 1A-7, there is shown blend and configuration control 100, 100' for use with an electric string instrument, such as the electric guitar 700. Blend and configuration control 100, 100' provides selective variation of the electrical configuration of a pair of pickup transducers 710, 720; 710',720' between being connected in series and being connected in parallel, as well as selecting either one of pickup transducers alone. In the series mode the output will be strong with a smooth attack and a deep tone, in the single pickup transducer modes the output will be a more classic single tone, and in the parallel mode, the sound will be very clean and sparkly.

As is known in the art, one or more pickup sensors or transducers are positioned in correspondence with the strings of the instrument so that they are able to produce an electrical signal in response to mechanical vibration from the stringed instrument. The terms "blending," "series blending," and "parallel blending," as used herein, refers to a proportional combining of the outputs of multiple pickup transducers, either in series or parallel, wherein the proportioning thereof is the result of some value of resistance in series with one or more of the pickup transducers. The terms "pickup sensor" and "pickup transducer" are used interchangeably herein and intended to be any device that converts mechanical vibration to electrical signals. While magnetic type pickup transducers are the most widely used and may comprise the pickup transducers 710, 720; 710', 720', other pickup sensors useable as pickup transducers 710, 720; 710', 720' include piezoelectric devices, optical sensors, microphones, combinations thereof, as well as any other device capable of generating an electrical signal in correspondence with mechanical vibration produced by the instrument. With respect to the popular magnetic pickup, Humbucker type pickups are commonly used with electric string instruments because they provide for cancellation of electromagnetic interference (EMI), such as the 50 or 60 Hz "hum" that is induced from nearby electrical power wiring. Humbucker type pickups typically have two pickup coils in a single package that are phased to provide cancellation of common mode signals which are made to be "out of phase" by the poling of the two pickup coils so that they cancel each other. A pair of separately located single coils can also be connected with opposing respective phases to provide cancellation of EMI. Blend and configuration control 100, 100' may incorporate a pair of collocated coils as well as separately located single coils in any phase relationship and located anywhere along the longitudinal extent of the strings on the instrument. Thus, they may be phased to provide noise cancellation or not, without departing from the inventive concepts embodied in blend and configuration control 100, 100'. Both series and parallel modes can be phased for hum canceling, however, while in the single pickup sensor mode, there will not be a hum canceling feature. Where an instrument uses multiple Humbucker type pickups, each would be wired in series or parallel and connect as an individual pickup transducer to the blend and configuration control 100, 100'. In this arrangement, the hum cancelling quality of each Humbucker type pickup sensor would still be maintained in the single pickup sensor mode.

Shown in FIG. 1A, is an exemplary electric string musical instrument 700 in the form of a guitar that incorporates blend and configuration control 100, 100'. As is typical of such musical instruments, guitar 700 includes a plurality of strings 10, the vibrations of which are sensed by the pickup sensors 710 and 720. Although only a single pickup sensor is necessary for the guitar to function as a musical instrument, a broad range and variation of sounds can be generated using multiple pickup sensors. The pickup sensor 710 is located on the guitar 700 in proximity to the bridge of the instrument. The bridge being an anchor point for the strings, limits the displacement of the strings adjacent thereto, so higher frequency components of the sound are transduced by the pickup sensor 710. The pickup sensor 720, on the other hand, is located in proximity to the neck of the guitar 700. As the neck region is a relatively substantial distance from the anchor points of the strings, the strings are able to vibrate with greater amplitude and thereby produce lower frequency components of the sound.

As a result of these differences in the sounds generated by pickup sensors 710 and 720, the musician playing guitar 700 will use blend and configuration control 100, 100' to select, blend or configure the signals output from the pickup sensors 710 and 720. Guitar 700 is provided with rotatable control knobs 702, 704 and **7*o*6 and optionally a switch control lever 708. Control knob 702 is connected to a tone control (not shown in the figures), allowing the musician to vary the sounds from the guitar 700 by changing the filtering applied to the electrical signals before they are coupled to the amplifier 300. Control knob 704 is connected to the shaft of the volume control potentiometer 200, allowing the musician to vary the volume while playing the instrument. Control knob 706 is connected to the mechanically coupled potentiometers 140 and 160, 240 and 260 of blend and configuration control 100, 100' to provide selection, blending and/or configuration changing of the pickup transducers 710 and 720. Where the switch 170 of blend and configuration control 100 is a push-pull type switch connected to the common shaft of potentiometers 140 and 16*o*, knob 706 also operates that control. Optionally, for blend and configuration control 100 the switch 170 may be operated by means of a switch control lever 708, allowing the musician to switch to and from a series configuration of pickup transducers 710 and 720 without disturbing the blend setting of the potentiometers 140 and 160**.

Figure 1B:
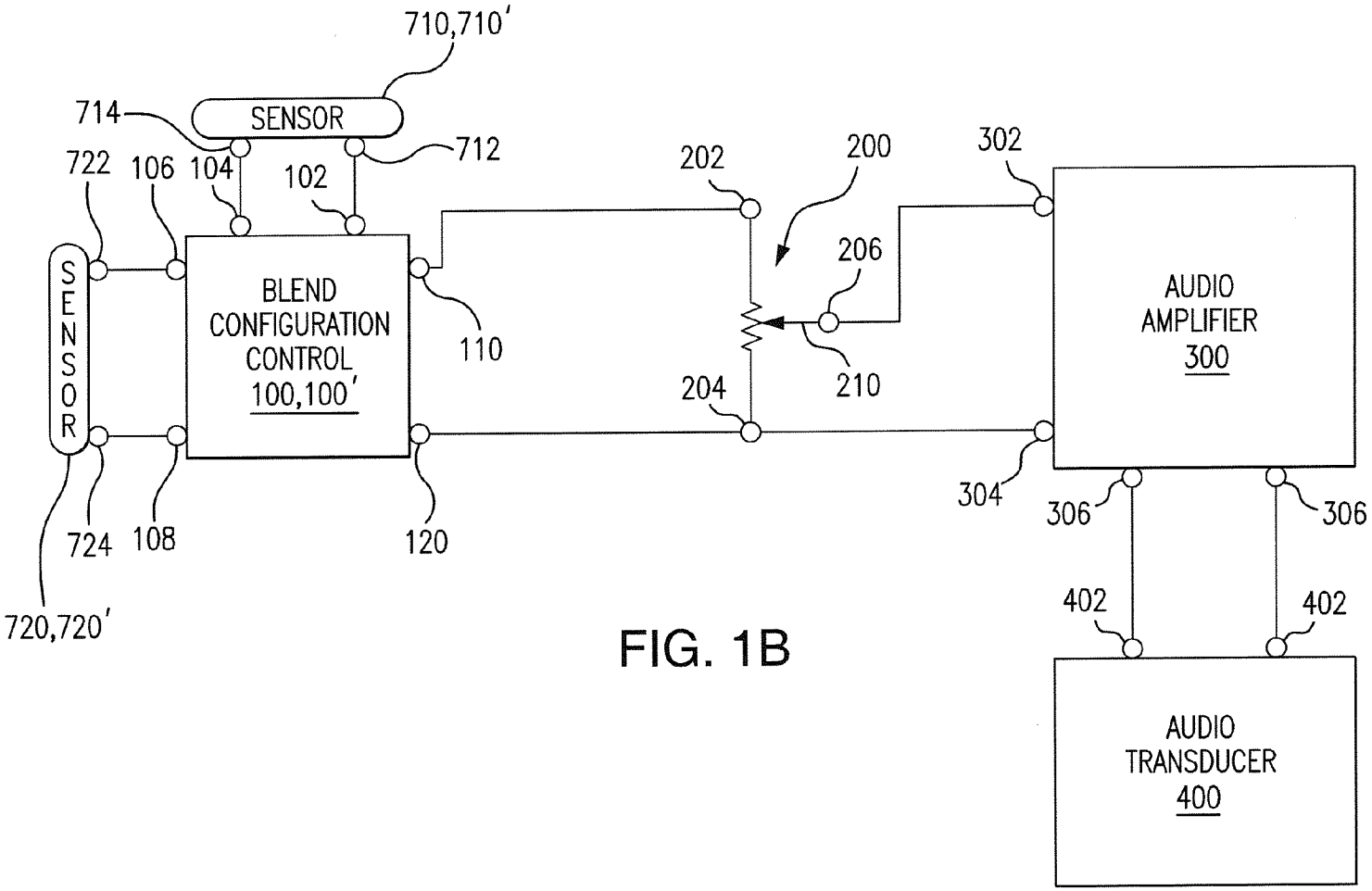
FIG. 1B is a block diagram illustrating the basic audio system for an electric string instrument incorporating the blend and configuration control of the present invention.

Referring now to FIG. 1B, there is shown a block diagram of the basic audio system for an electric string instrument that incorporates the novel blend and configuration control 100, 100' disclosed herein. Blend and configuration control 100, 100' combines or selects signals from the multiple pickup sensors 710 and 720 to obtain a variation of sounds from the stringed instrument, such as guitars, violins, cellos, harps, banjos, mandolins, bases, etc. In blend and configuration control 100 the multiple pickup sensors 710 and 720 can be combined in series, parallel or a parallel blending of the outputs of the two pickup sensors. In blend and configuration control 100' the multiple pickup sensors 710 and 720 can be combined in series, a series blending of the outputs of the two pickup sensors or selection of either one pickup sensors 710 and 720 alone. As will be discussed in following paragraphs, either or both of pickup sensors 710 and 720 may be a Humbucker type pickup. It should also be noted that the two pickup coils of a single Humbucker type pickup my represent pickup sensors 710 and 720, as well.

Each of pickup sensors 710 and 720 generates voltage signals responsive to the vibrational movement of the strings 10, either directly or indirectly, of a stringed instrument 700 that are output at the terminals 712 and 714, and 722 and 724, respectively. The outputs 712 and 714 are respectively coupled to input terminals 102 and 104 of blend configuration control 100, 100' by appropriate leads. Similarly, the output terminals 722 and 724 are respectively coupled to input terminals 106 and 108 of blend configuration control 100, 100' by another pair of appropriate leads. Appropriate leads that define the pairs of leads connecting pickup sensors 710 and 720 to blend and configuration control 100, 100' may include leads incorporated into shielded cables as well as twisted pairs of wires and individual unshielded or shielded wires, or the like. The generated signals from the pickup sensors that are blended or selected are output to terminals 110 and 120, which are respectively connected to terminals 202 and 204 of volume control 200. Volume control 200 is a potentiometer that functions as a voltage divider with its displaceable contact 210 connected to an output terminal 206. The signal level at output terminal 206 relative to terminal 204 will be in relation to the resistance between those terminals with respect to the total resistance between terminals 202 and 204. The output of volume control 200 provided from terminals 206 and 204 is respectively coupled to terminals 302 and 304 of an audio amplifier 300. Although not illustrated in FIG. 1B, it is common to add various additional tone controls between either the output of volume control 200 and the input of audio amplifier 300 or between the output of blend configuration control 100, 100' and the input of volume control 200. Such tone controls are typically in the form of resistance-capacitance (RC) filters where the resistance element is a potentiometer.

The output signal level of blend and configuration control 100, 100' may be on the order of 100-500 mV, which can then be reduced by adjustment of volume control 200. Audio amplifier 300 increases the signal level, voltage and current, sufficiently to drive an audio transducer 400, such as headphones or one or more speakers. The output terminals 306 of audio amplifier 300 are connected to the input terminals 402 of audio transducer 400. Although, audio amplifier 300 is shown with a single pair of output terminals, it should be understood that multiple separate outputs may be provided to simultaneously drive a plurality of audio transducers 400.

Figure 1C:
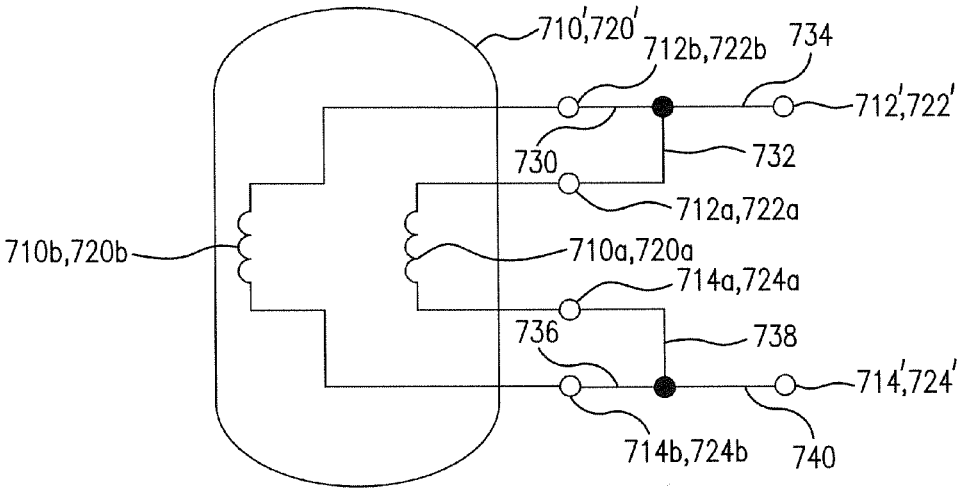
FIG. 1C is a schematic illustration of a Humbucker type pickup sensor for string instruments useable in the present invention with the sensing coils wired in parallel.
Figure 1D:
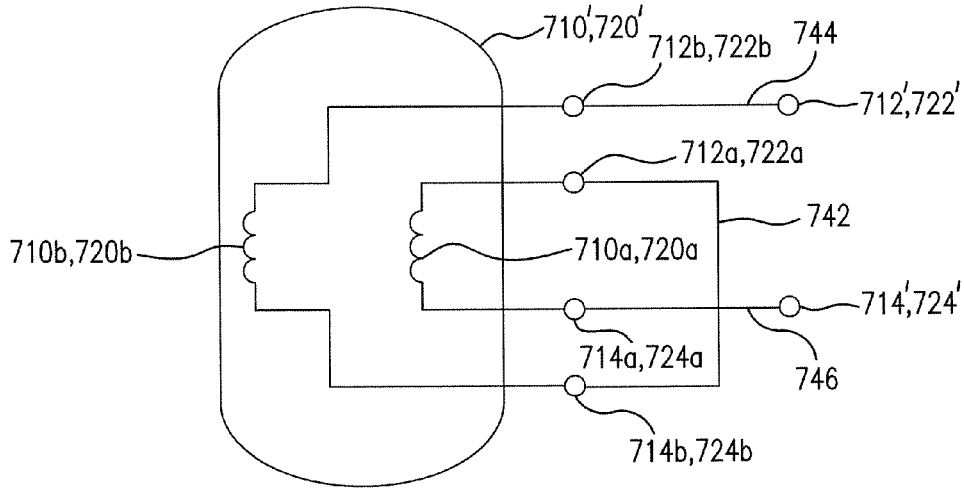
FIG. 1D is a schematic illustration of a Humbucker type pickup sensor for string instruments useable in the present invention with the sensing coils wired in series.

FIGS. 1C and 1D show schematic illustrations of a Humbucker type pickup sensor 710', 720' which may respectively replace the pickup sensors 710 and 720 of the guitar 700 shown in FIG. 1A, and connected to blend and configuration control 100, 100' shown in FIG. 1B. Each pickup sensor 710', 720' includes a pair of coils **710*a*, 720*a* and 710*b*, 720*b*. Coil 710*a*, 720*a* has a pair of terminals 712*a*, 722*a* and 714*a*, 724*a* connected to opposing ends thereof. Similarly, coil 710*b*, 720*b* has a pair of terminals 712*b*, 722*b* and 714*b*, 724*b* connected to its opposing ends. As is known in the art, Humbucker pickups are arranged to be of opposite magnetic and electric polarity so as to produce a differential signal. Since ambient electromagnetic noise affects both coils equally and since the coils are poled oppositely, the noise signals induced in the two coils cancel out. The two coils of the Humbucker pickup sensor 710', 720' are often wired in series to give a fuller and stronger sound, as shown in FIG. 1D. The two coils of the Humbucker pickup sensor 710', 720' can also be connected in parallel, as shown in FIG. 1**C, which results in a brighter sound, albeit with a weaker output, but with the pickup's hum-cancelling properties still being retained.

As shown in FIG. 1C, the two coils 710*a* and 710*b*; 720*a* and 720*b* coupled in parallel. Each pickup sensor 710' and 720' has the terminals 712*a*, 722*a* and 712*b*, 722*b* connected to each other by a conductor 732 and which are connected in common to a conductor 734 connected to an output terminal 712', 722'. Likewise, the terminals 714*a*, 724*a* and 714*b*, 724*b* are connected to each other by a conductor 738 and which are further connected in common to a conductor 740 connected to an output terminal 714', 724'. Where a Humbucker pickup sensor 710', 720', having coils 710*a* and 710*b*; 720*a* and 720*b* wired in parallel is used in place of another type of pickup sensor 710, 720, the output terminals 712', 722' and 714', 724' thereof would be respectively connected to blend configuration control 100, 100' input terminals 102, 106 and 104, 108.

In FIG. 1D, the two coils 710*a* and 710*b*; 720*a* and 720*b* coupled in series. The terminal 712*b*, 722*b* of pickup coil 710*b*, 720*b* is connected to the output terminal 712', 722' by a conductor 744. The opposing terminal 714*b*, 724*b* of pickup coil 710*b*, 720*b* is connected to the terminal 712*a*, 722*a* of pickup coil 710*a*, 720*a* by a conductor 742, and the opposing terminal 714*a*, 724*a* of pickup coil 710*a*, 720*a* is connected to the output terminal 714', 724' by a conductor 746. Thus, just as for the parallel wired Humbucker pickup sensor, where the Humbucker pickup sensor 710', 720', of FIG. 1D is used in place of another type of pickup sensor 710, 720, the output terminals 712', 722' and 714', 724' thereof would be respectively connected to blend configuration control 100, 100' input terminals 102, 106 and 104, 108. Accordingly, either one or both pickup sensors may be a Humbucker type pickup sensor with the pickup coils thereof wired in series or parallel to provide a desired sound effect. In one working embodiment, pickup sensors 710' and 720' were implemented with a humbucking series EMG-HZ type pickup available from EMG, Inc. of Santa Rosa, Calif.

Turning now to FIGS. 2-7, there are shown schematic diagrams of blend and configuration control 100 respectively at different settings to demonstrate the changes in the configuration of pickup sensors 710 and 720 that are obtained thereby. Blend and configuration control 100 includes a pair of potentiometers 140 and 160 that provide the mechanism for changing the blending of the pair of pickup sensors 710 and 720 between being coupled in parallel at an intermediate position of the mechanical travel of displaceable contacts 148 and 168 of potentiometers 140 and 160; coupling one or the other of pickup sensors 710 and 720 respectively at the opposing ends of the mechanical travel thereof; and, providing a range of parallel blending of the outputs of pickup sensors 710 and 720 at other positions between the intermediate position and the opposing end positions of the mechanical travel of displaceable contacts 148 and 168 of potentiometers 140 and 160. Blend and configuration control 100 further includes a switch 170 that provides the mechanism for reversibly changing the configuration of pickup sensors 710 and 720 from that established by potentiometers 140 and 160, when the switch is in the A position, to a configuration where the two pickup sensors 710 and 720 are connected in series, irrespective of what the potentiometers 140 and 160 have been set to, when switched to the B position.

A first pickup sensor 710, pickup sensor A, has output terminals 712 and 714 respectively connected to a first pair of input terminals 102 and 104 of blend and configuration control 100. Similarly, a second pickup sensor 720, pickup sensor B, has output terminals 722 and 724 respectively connected to a first pair of input terminals 106 and 108 of blend and configuration control 100. Although pickup sensor A has been illustrated as being the "bridge pickup" and pickup B as the "neck pickup," it should be understood that their position is immaterial to the inventive concepts being disclosed herein and their relative positions on the instrument 700 could be interchanged. Input terminal 108 is coupled to output terminal 120 of blend and configuration control 100 through the conductor 113, node 111 and conductor 119. Although not shown, node 111 may be coupled to a ground reference potential in order to reduce electrical noise and for electrical safety.

Potentiometers 140 and 160 each include a resistive element 150, 180 connected between a respective pair of terminals 142, 144 and 162, 164, and a displaceable contact 148, 168 respectively coupled to a terminal 146, 166. Potentiometers 140 and 160 are mechanically coupled together, as represented by the coupling line 190, and may be rotary or linear movement types, with the resistive elements 150, 180 each having a value in the approximate range of 125 KΩ to 500 KΩ. In one working embodiment, potentiometers 140 and 160 were implemented as rotary type dual-gang potentiometers, which are two potentiometers combined on a common shaft, available from Bourns, Inc. of Riverside, Calif. and having the designation PDB182-GTRB with resistive elements 150 and 180 being 500 KΩ.

Potentiometer 140 has a resistance at 0% output at the displaceable contact 148, terminal 146, with respect to terminal 142 over the initial portion of mechanical travel of the displaceable contact 148 from the end of the resistive element 150 connected to terminal 142 defined by the resistive element portion 152, and increases linearly (linear taper) from 0% to 100% of the resistance over the remaining portion of the travel, defined by the resistive element portion 154. For the exemplary dual gang potentiometer identified above, the initial and remaining portions of the mechanical travel of the displaceable contacts 148 and 168 are 50% of the mechanical travel. While potentiometer 160 is constructed oppositely, with the resistance at the displaceable contact 168, terminal 166, with respect to terminal 162 decreasing linearly (linear taper) from 100% to 0% over the initial portion of mechanical travel of the displaceable contact 168 from the end of resistive element 180 connected to terminal 162 defined by the resistive element portion 182, and remains at 0% over the remaining portion of the travel, defined by the resistive element portion 184. In some applications the musician who owns the string instrument incorporating blend and configuration control 100 may prefer a nonlinear resistive taper, such as logarithmic taper which is also known as an audio taper, for either or both of potentiometers 140 and 160. Regardless of the taper, tone control 500 will function as described herein with respect to the blending and switching effect at the endpoints of mechanical travel of the displaceable contacts 148, 168 and at the intermediate position of the mechanical travel where the respective element portions 152, 182 and 154, 184 join, and those positions therebetween. Although, in the exemplary circuit described with respect to FIGS. 2-7 the intermediate position is in fact the approximate midpoint of the mechanical travel, it can be located at other positions, in concert with the use of other resistive tapers or independent thereof.

Looking more specifically at the circuit connections, input terminal 102 is connected to switch terminal 181 via conductor 112 to a node 121 and from node 121 through conductor 123. All of the conductors of blend and configuration control 100 may formed by conductive wires, conductive tracks on a printed circuit board, or a combination thereof. Input terminal 104 is connected to the common terminal 178 of switch 170 by the conductor 114. Input terminal 106 is coupled to a node 115 by the conductor 116, and the node 115 is coupled to switch terminal 172 by the conductor 117. Node 115 is also coupled to the terminal 183 of switch 170 by conductor 126, and the node 121 has a further connection to the displaceable contact terminal 166 of potentiometer 160. Node 111 is connected to the switch terminal 174 by conductor 118. Common switch terminal 176 of switch 170 is connected to the displaceable contact terminal 146 of potentiometer 140 by conductor 128. Terminal 144 of potentiometer 140 and terminal 162 of potentiometer 160 are open circuited, without any connection to any other terminal or component. Finally, terminal 142 of potentiometer 140 is connected to terminal 164 of potentiometer 160 by conductor 132, and thereby terminals 142 and 164 are connected in common with output terminal 110 by conductor 130

Figure 2:
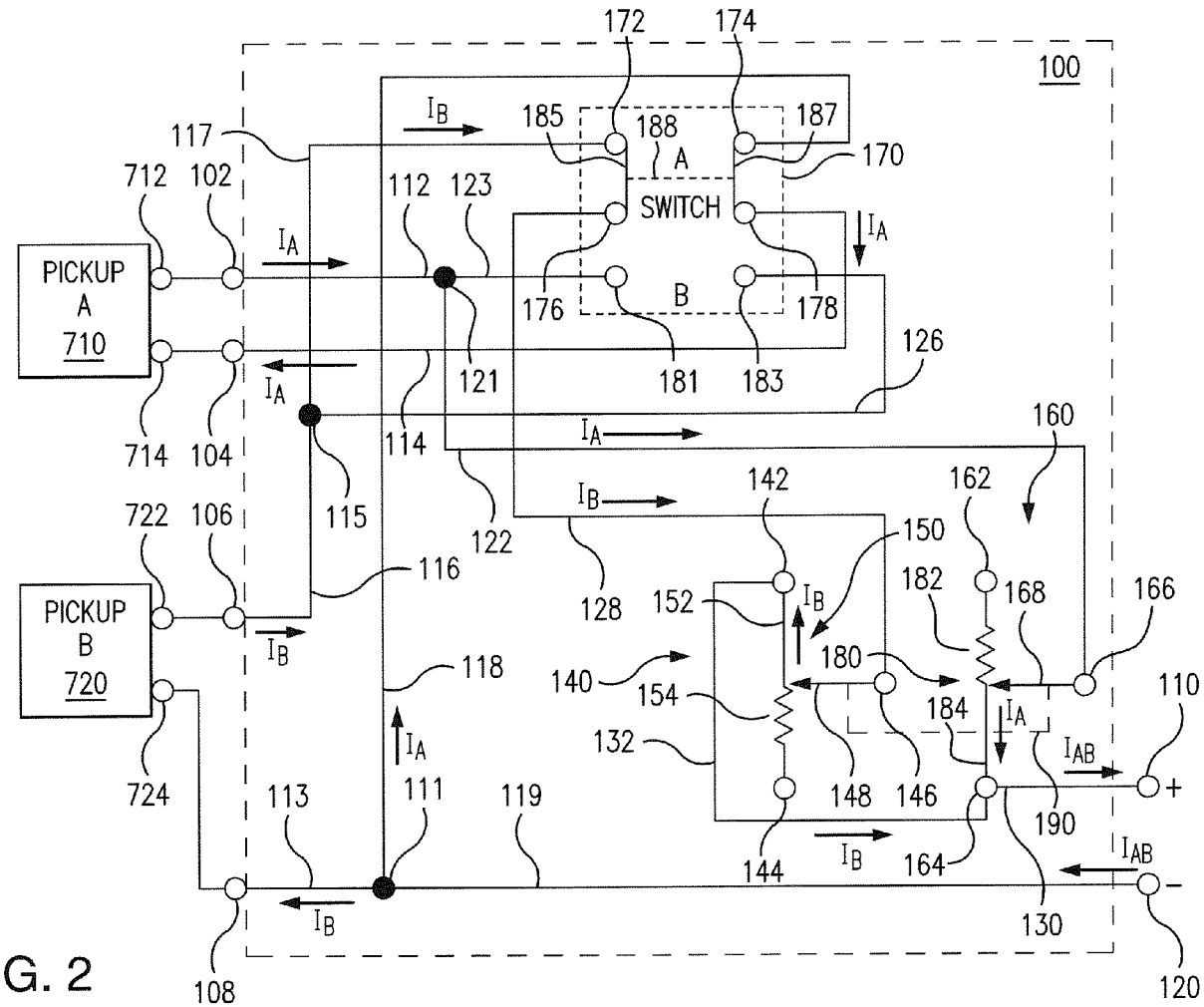
FIG. 2 is a schematic electrical diagram of the blend and configuration control of the present invention adjusted for a parallel blend configuration.

The functioning of blend and configuration control 100 will now be described, beginning with the displaceable contacts 148, 168 being at the intermediate position of their mechanical travel, the position where the respective element portions 152, 182 and 154, 184 join, as illustrated in FIG. 2. At the intermediate position of the mechanical travel, the resistance between the terminals 146 and 142, as well as between terminals 166 and 164 of potentiometers 140 and 160 is respectively zero ohms. Switch 170 has two poles. One pole includes a common terminal 176 that connects to the terminal 172 when the switch is in position A and connects to the terminal 181 when the switch is in the B position by means of the switch contact 185. The other pole includes a common terminal 178 that connects to the terminal 174 when the switch is in position A and connects to the terminal 183 when the switch is in the B position by means of the switch contact 187. The two switch contacts are mechanically coupled together for concurrent movement between the A and B positions, as indicated by the coupling line 188.

With reference to FIG. 2, the switch 170 will initially be in the A position. Pickup sensor 710 provides a current $I_A$ that flows from terminal 712 to input terminal 102 and through conductor 112, node 121 and conductor 122 to terminal 166 of potentiometer 160. The current $I_A$ flows through the displaceable contact 168 and the restive element portion 184 to terminal 164 of potentiometer 160. As the terminal 162 of potentiometer 160 is open circuited, no current flows in that direction. Pickup sensor 720 provides a current $I_B$ that flows from terminal 722 to input terminal 106 and through conductor 116, node 115 and conductor 117 to switch terminal 172 of switch 170. As switch 170 is in the A position, the switch contact 185 electrically connects terminal 172 to the common switch terminal 176. From the common switch terminal 176 the current $I_B$ flows through conductor 128 to the terminal 146 of potentiometer 140. The current $I_B$ flows through the displaceable contact 148 and the resistive element portion 152 to terminal 142 of potentiometer 140. From terminal 142 the current $I_B$ flows through the conductor 132 to terminal 164 of potentiometer 160, where the current $I_B$ joins the current $I_A$ and the combined current $I_{AB}$ flows from terminal 164 to the output terminal 110.

The return combined current $I_{AB}$ flows into output terminal 120 and therefrom through conductor 119 to node 111, where the current divides with the pickup sensor current $I_B$ flowing from node 111 through conductor 113 to input terminal 108 and from there to the terminal 724 of pickup sensor 720. The pickup sensor current $I_A$ flows from node 111 through conductor 118 to the switch terminal 174 of switch 170. Here again, with switch 170 being in the A position, the switch contact 187 electrically connects the terminal 174 to the common switch terminal 178. Therefore, from the common switch terminal 178 the current $I_A$ flows through conductor 114 to input terminal 104 and from there to the terminal 714 of pickup sensor 710. Hence, with switch 170 in the A position and the displaceable contacts 148 and 168 being at the intermediate position of their mechanical travel, the pickup sensors are connected in a parallel configuration, as set by the displaceable contacts 148, 168 being at the intermediate position of their mechanical travel.

Figure 3:
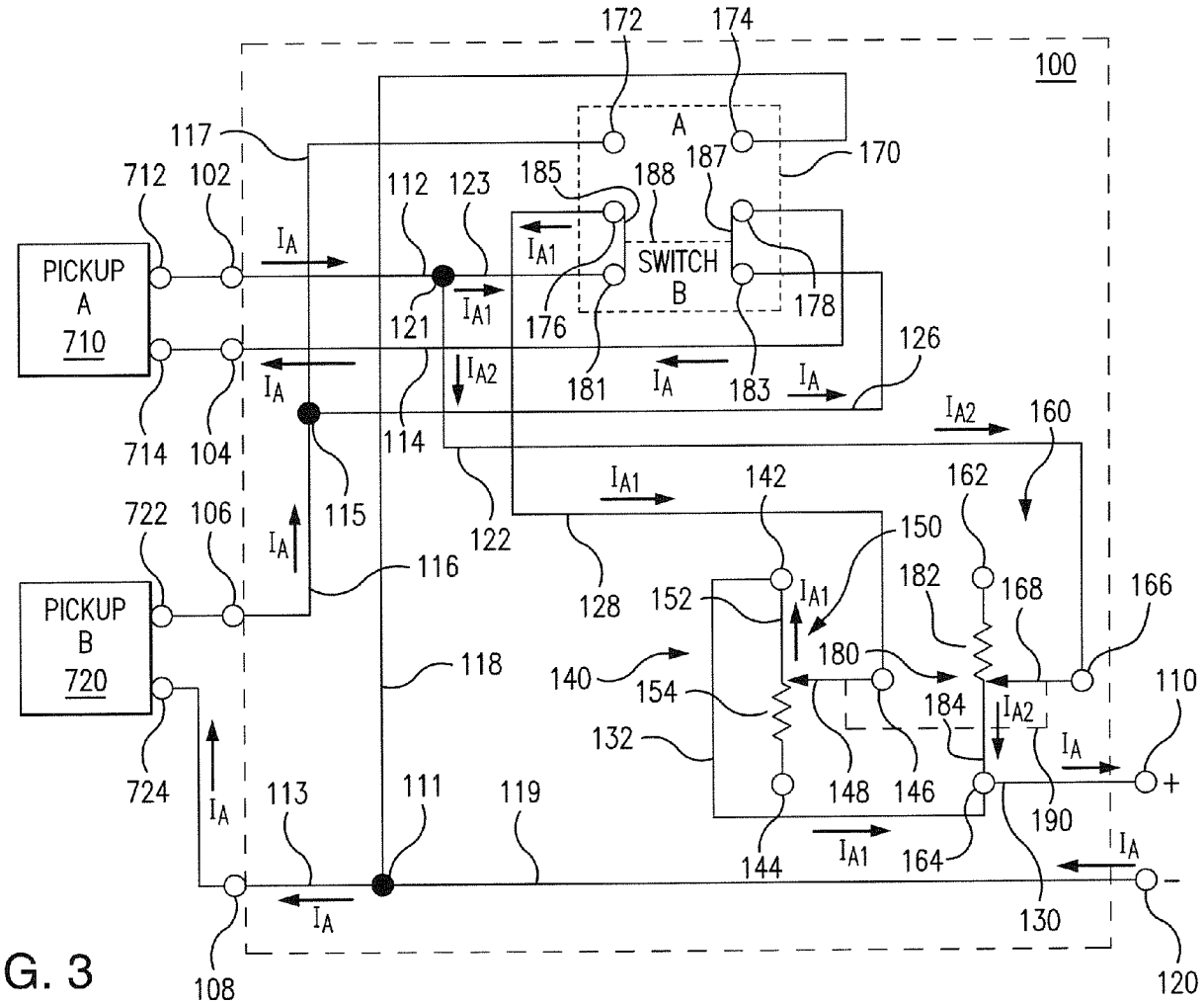
FIG. 3 is a schematic electrical diagram of the blend and configuration control adjusted to the parallel blend configuration of FIG. 2, but switched to a series configuration.

In FIG. 3, the functioning of blend and configuration control 100 will be examined with the position of the displaceable contacts 148 and 168 of potentiometers 140 and 160 remaining in the same position as in FIG. 2, and the switch 170 changed to the B position. Starting at pickup sensor 710, such generates a current $I_A$ responsive to string vibration. The current $I_A$ flows from terminal 712 to input terminal 102 and therefrom to node 121 through conductor 112. At node 121 the current divides with one component thereof, current $I_{A1}$ flowing through conductor 123 to switch terminal 181. Another current component, current $I_{A2}$ flows from node 121 through conductor 122 to terminal 166 of potentiometer 160 and through displaceable contact 168 and resistive element portion 184 to terminal 164 of potentiometer 160. The current $I_{A1}$ flows from switch terminal 181 to the common switch terminal 176 through the switch contact 185. From the common switch terminal 176, the current $I_{A1}$ flows through conductor 128 to terminal 146 of potentiometer 140. The current $I_{A1}$ flows from terminal 146, through displaceable contact 148 and the resistive element portion 152 to the terminal 142 of potentiometer 140. From terminal 142 the current $I_{A1}$ flows through the conductor 132 to terminal 164 of potentiometer 160, where the current $I_{A1}$ joins the current $I_{A2}$ and the combined current $I_A$ flows from terminal 164 to the output terminal 110. Although the ratio of the currents $I_{A1}$ to $I_{A2}$ is immaterial to the operation of blend and configuration control 100, since the two current paths consist of low resistive conductive paths, they can, for practical purposes, be considered equal.

The return current $I_A$ flows into output terminal 120 and therefrom through conductor 119 to node 111, through conductor 113 to input terminal 108 and from there to the terminal 724 of pickup sensor 720. The current $I_A$ flows from terminal 722 to input terminal 106 and through conductor 116, node 115 and conductor 126 to switch terminal 183. From switch terminal 183 the current $I_A$ flows through switch contact 187 to common switch terminal 178. From common switch terminal 178, the current $I_A$ flows through conductor 114 to input terminal 104 and to output terminal 714 of pickup sensor 710 to return thereto. Thus, with switch 170 switched into the B position, with the displaceable contacts 148 and 168 being at the intermediate position of their mechanical travel, the pickup sensors are thereby connected in a series configuration. As will become apparent in following paragraphs, when switch 170 is in the B position, it does not matter to what position the displaceable contacts 148 and 168 are in, he pickup sensors will always be connected in a series configuration thereby.

Figure 4:
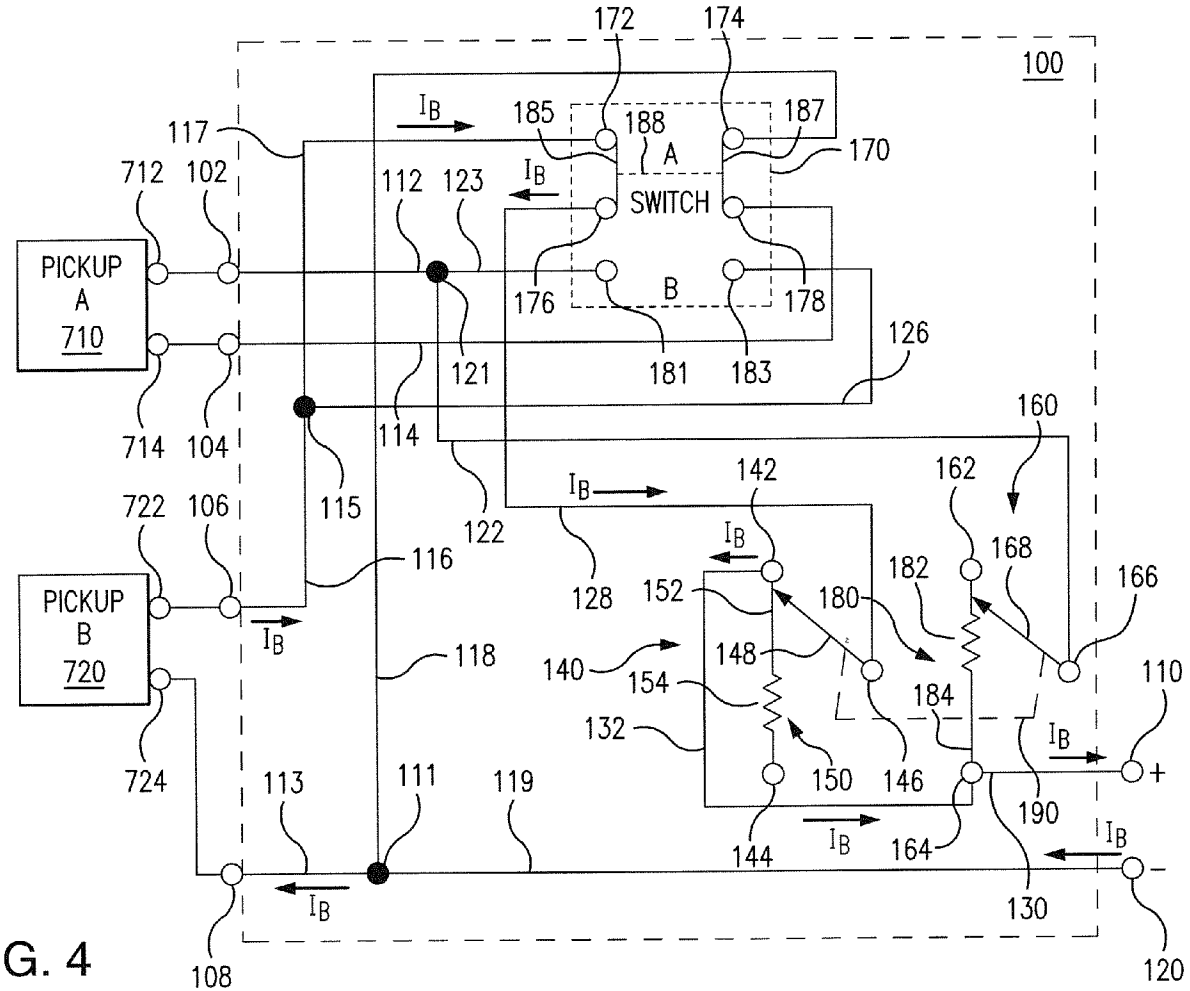
FIG. 4 is a schematic electrical diagram of the blend and configuration control adjusted for a single pickup transducer configuration.

Referring now to FIG. 4, the functioning of blend and configuration control 100 will be examined with the position of the displaceable contacts 148 and 168 of potentiometers 140 and 160 disposed at one end of their mechanical travel, and the switch 170 changed back to the A position. At the settings shown in FIG. 4, the connection of output terminal 712 of pickup sensor 710, through its connection to input terminal 102 and conductor 112, node 121 and conductor 123 is connected to the open switch terminal 181 of switch 170. Node 121 is also coupled to terminal 166 of potentiometer 160 by conductor 122. With the displaceable contact at the end of mechanical travel shown, the entire resistance of the resistive element 180 is provided between the displaceable contact 168 and the terminal 164 of potentiometer 160. The resistance value of the resistive element portion 182 is sufficiently high such that any current that flows therethrough is insignificant and thus, for all practical purposes, no current is considered to flow therethrough. Therefore, no current flows from pickup sensor 710 that is supplied to the output terminals 110 and 120.

At other positions of the displaceable contacts 148 and 168 between the intermediate position discussed with respect to FIG. 2 and the end position shown in FIG. 4, the resistance from terminal 166 and 164 will not be as great (no longer being 100 percent of the value of the resistive element) and a current $I_A$, albeit of reduced magnitude due to the percentage of the resistance of the resistive element portion 182 in series with terminals 166 and 164, and as the terminal 714, coupled to input terminal 104, is coupled to node 111 via conductors 118 and 114 via switch contact 187 and terminals 174 and 178, there will be a contribution to the output signal from pickup sensor 710 from the parallel configuration provided thereby.

Getting back to the displaceable contact positions shown in the figure, pickup sensor 720 outputs a current $I_B$ that flows from terminal 722 to input terminal 106 and through conductor 116, node 115 and conductor 117 to switch terminal 172 of switch 170. The current $I_B$ flows from terminal 172 to the common switch terminal 176 through the switch contact 185. From common switch terminal 176 the current $I_B$ flows through the conductor 128 to terminal 146 of potentiometer 140. The current $I_B$ flows from terminal 146 to the terminal 142 of potentiometer 140 through the displaceable contact 148 to terminal 142 and through the conductor 132 to terminal 164 of potentiometer 160. The current $I_B$ flows from terminal 164 to output terminal 110 through conductor 130, and the current $I_B$ returns to output terminal 120 and flows to terminal 724 of pickup sensor 720 through conductor 119, node 111 and conductor 113 to input terminal 108 that in turn is connected to terminal 724 of pickup sensor 720.

Figure 5:
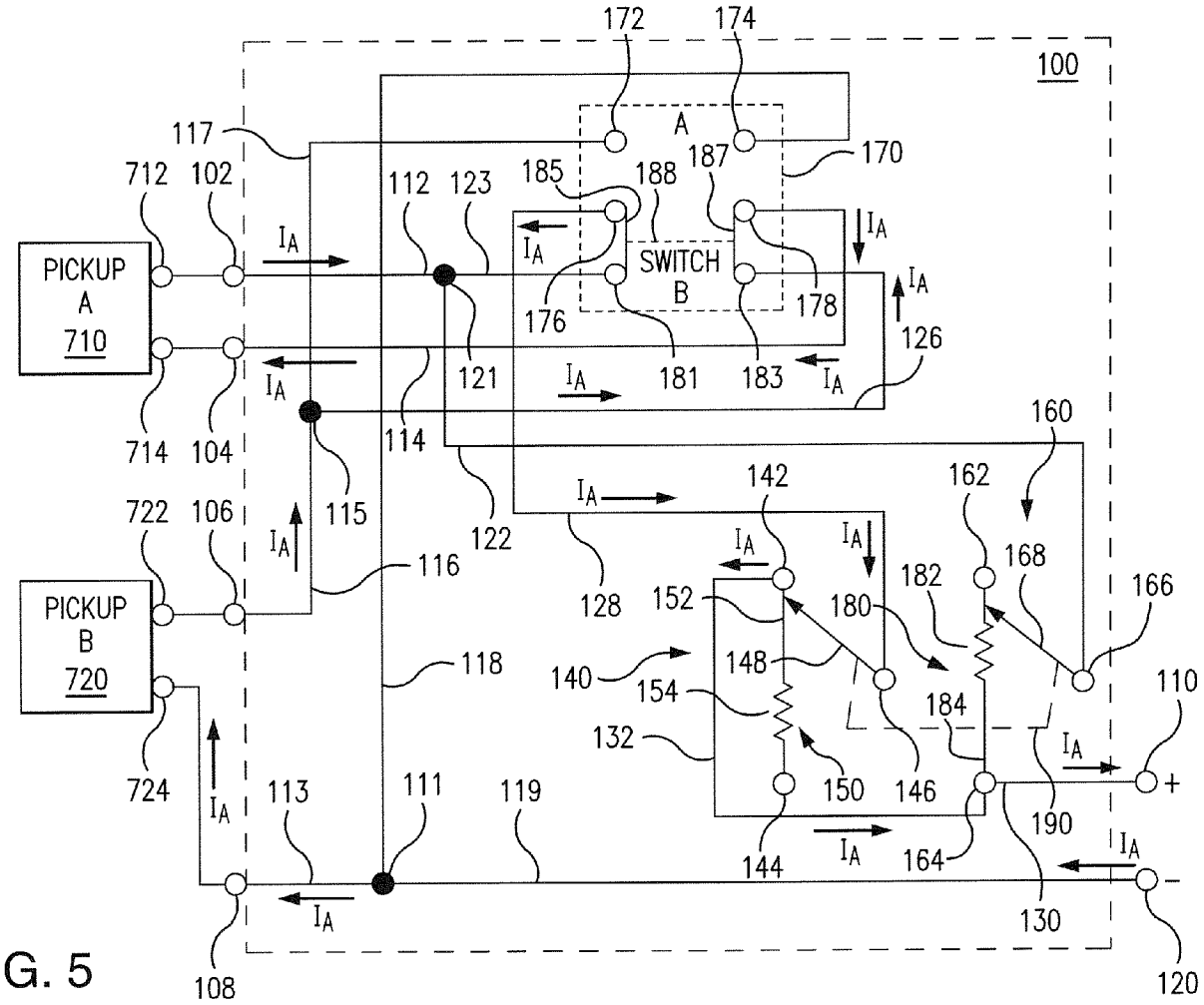
FIG. 5 is a schematic electrical diagram of the blend and configuration control adjusted for a single pickup transducer configuration of FIG. 4, but switched to a series configuration.

Turning now to FIG. 5, the functioning of blend and configuration control 100 will be examined with the position of the displaceable contacts 148 and 168 of potentiometers 140 and 160 remaining in the same position as in FIG. 4, and the switch 170 changed to the B position. Starting at pickup sensor 710, the current $I_A$ is output from terminal 712 and flows to input terminal 102. From terminal 102 the current $I_A$ flows to node 121 through conductor 112. The current $I_A$ flows through conductor 123 to switch terminal 181 and from switch terminal 181 to the common switch terminal 176 through the switch contact 185. From the common switch terminal 176, the current $I_A$ flows through conductor 128 to terminal 146 of potentiometer 140. The current $I_A$ flows from terminal 146, through displaceable contact 148 and the end portion of resistive element portion 152 to the terminal 142 of potentiometer 140. From terminal 142 the current $I_A$ flows through the conductor 132 to terminal 164 of potentiometer 160, where the current $I_A$ then flows from terminal 164 to the output terminal 110.

The return current $I_A$ flows into output terminal 120 and therefrom through conductor 119 to node 111, through conductor 113 to input terminal 108 and from there to the terminal 724 of pickup sensor 720. The current $I_A$ flows from terminal 722 to input terminal 106 and through conductor 116, node 115 and conductor 126 to switch terminal 183. From switch terminal 183 the current $I_A$ flows through switch contact 187 to common switch terminal 178. From common switch terminal 178, the current $I_A$ flows through conductor 114 to input terminal 104 and to output terminal 714 of pickup sensor 710 to return thereto.

Due to the high resistance, 100 percent of the value of resistive element 180, no current flows from node 121 to terminal 166 of potentiometer 160. However, at positions of the displaceable contacts 148 and 168 between the intermediate position discussed with respect to FIG. 2 and the end position shown in FIGS. 4 and 5, the resistance from terminal 166 and 164 will not be as great (no longer being 100 percent of the value of the resistive element) and a component of the current $I_A$, will flow from node 121 to terminal 146, to flow through the resistive element 180 to combine with a remaining portion of the current $I_A$, so that still the current $I_A$ is output at terminal 110. Thus, with switch 170 being switched into the B position, with the displaceable contacts 148 and 168 being at an end position or at any position between that end position and the intermediate position of the mechanical travel of displaceable contacts 148 and 168, the pickup sensors are thereby switched to be in a configuration where both pickup sensors 710 and 720 are connected in series.

Figure 6:
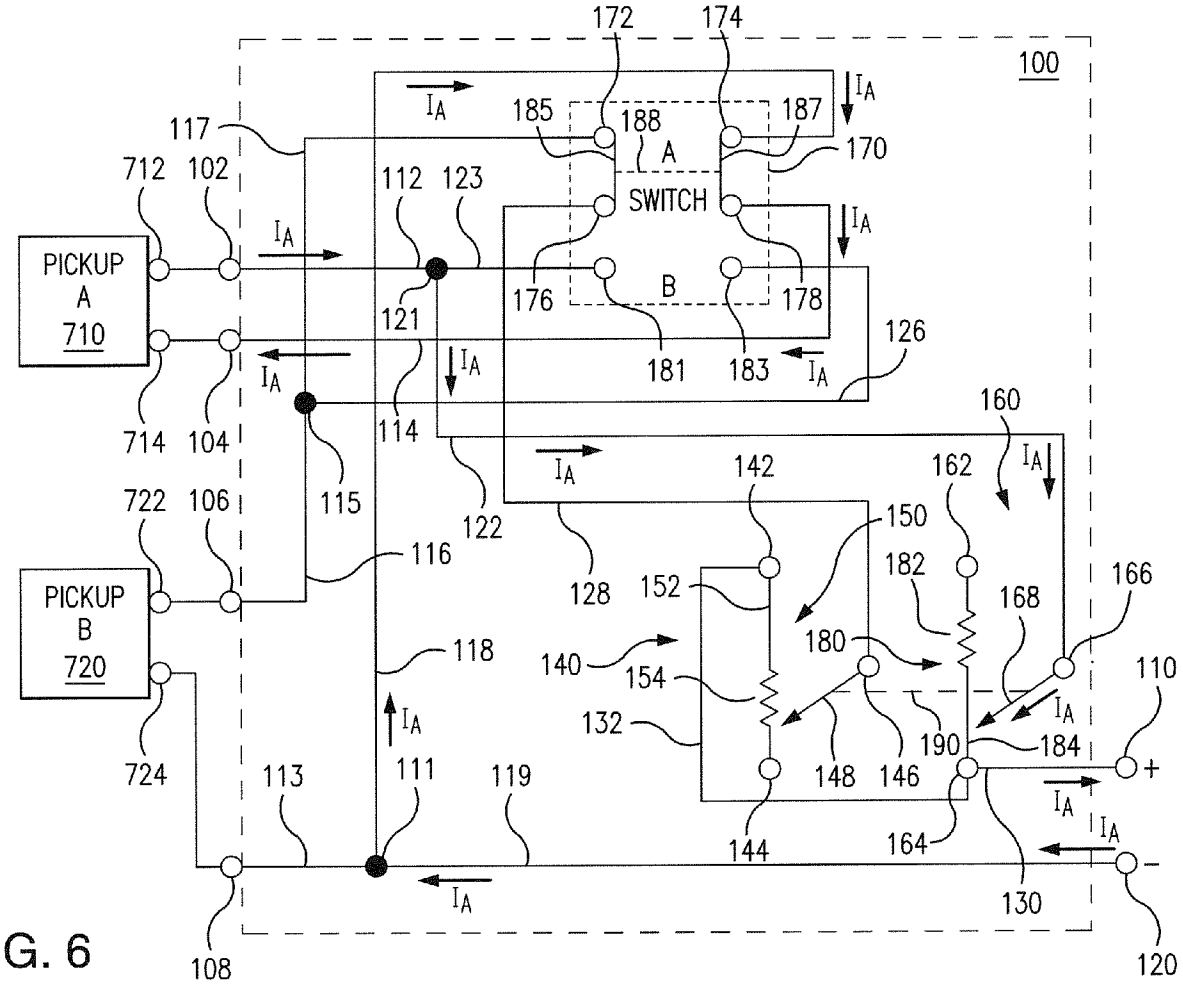
FIG. 6 is a schematic electrical diagram of the blend and configuration control adjusted for another single pickup transducer configuration.

In FIG. 6, the displaceable contacts 148 and 168 of potentiometers 140 and 160 are at the opposing end position from that described with respect to FIGS. 4 and 5. Here we examine the functioning of blend and configuration control 100 with the switch 170 switched to the A position. At the settings shown in FIG. 6, the connection of output terminal 722 of pickup sensor 720, through its connection to input terminal 106 and conductor 116, node 115 and conductor 126 is connected to the open switch terminal 183 of switch 170. Node 115 is also coupled to switch terminal 172 and from there to common switch terminal 176 through switch contact 185. Common switch terminal 176 is connected to terminal 146 of potentiometer 140 by conductor 128. With the displaceable contact at the end of mechanical travel shown, the entire resistance of the resistive element 150 is provided between the displaceable contact 148 and the terminal 142 of potentiometer 140. The resistance that is provided in the resistive element portion 154 is sufficiently high that any current that flows therethrough is insignificant and thus, for all practical purposes, no current flows there therethrough. Therefore, no current flows from pickup sensor 720 that is supplied to the output terminals 110 and 120.

At positions of the displaceable contacts 148 and 168 between the intermediate position discussed with respect to FIG. 2 and the end position shown in FIG. 6, the resistance from terminal 146 and 142 will not be as great (no longer being 100 percent of the value of the resistive element) and a current $I_B$, albeit of reduced magnitude due to the percentage of the resistance of the resistive element portion 154 in series with terminals 146 and 142, and as the terminal 724 is coupled to node 111 via input terminal 108 and conductor 113, there will be a contribution to the output signal from pickup sensor 720 from the parallel configuration provided thereby.

Referring back to the displaceable contact positions shown in the figure, the pickup sensor 710 outputs a current $I_A$ that flows from terminal 712 to input terminal 102 and through conductor 112, node 112 and conductor 122 to terminal 166 of potentiometer 160. The current $I_A$ flows from terminal 166 to the terminal 164 of potentiometer 160 through the displaceable contact 168 to terminal 164, to flow through conductor 130 to output terminal 110. The current $I_A$ returns to output terminal 120 and flows to switch terminal 174 of switch 170 through conductor 119, node 111 and conductor 118. From switch terminal 174, the current $I_A$ flows to common switch terminal 178 through the switch contact 187 to input terminal 104 through the conductor 114. The input terminal 104 is in turn is connected to terminal 714, completing the circuit for pick up sensor 710.

Figure 7:
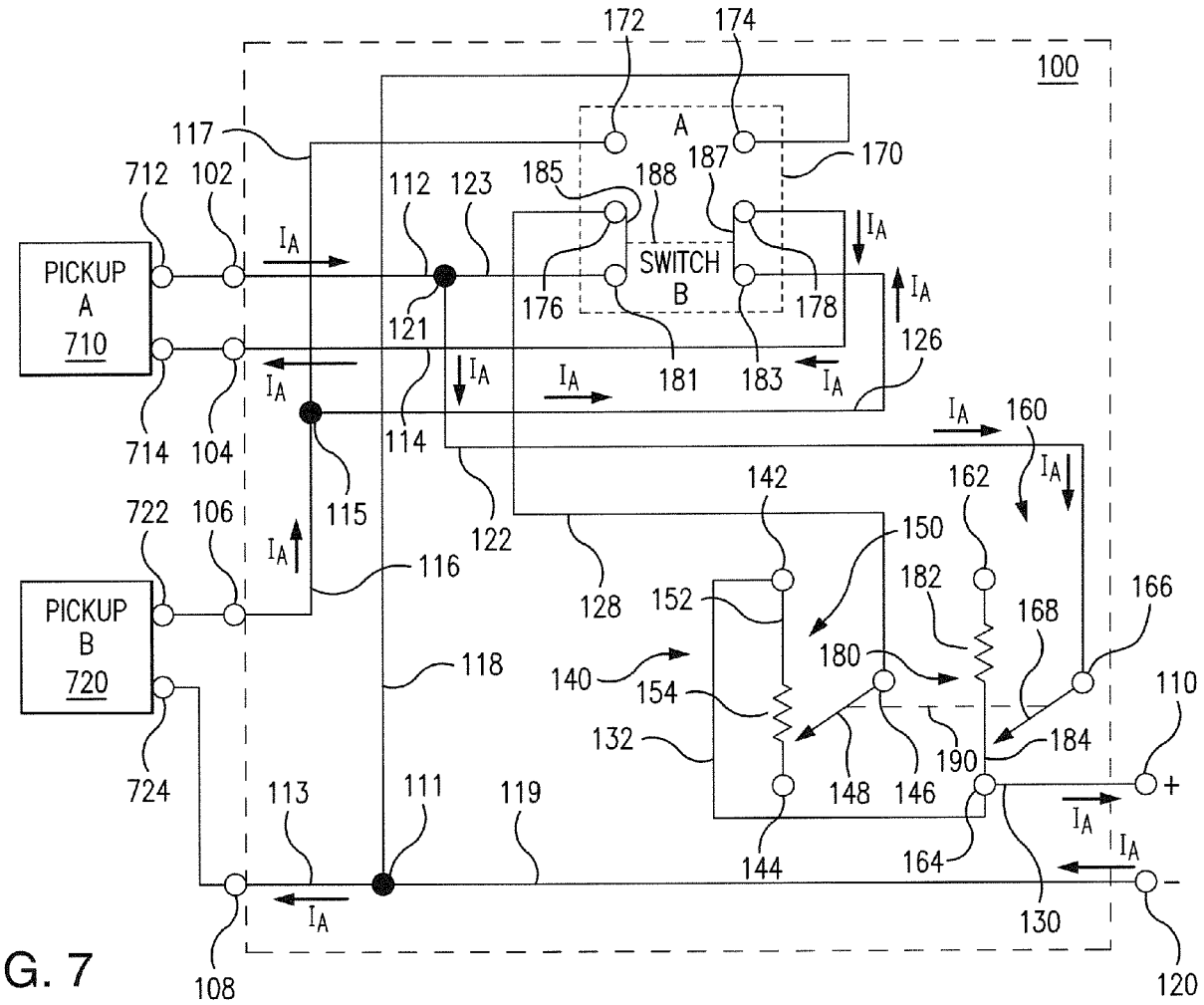
FIG. 7 is a schematic electrical diagram of the blend and configuration control adjusted for another single pickup transducer configuration of FIG. 6, but switched to a series configuration.

Turning now to FIG. 7, the functioning of blend and configuration control 100 will be examined with the position of the displaceable contacts 148 and 168 of potentiometers 140 and 160 remaining in the same position as in FIG. 6, and the switch 170 switched to be in the B position. Starting at pickup sensor 710, the current $I_A$ is output from terminal 712 and flows to input terminal 102. From terminal 102 the current $I_A$ flows to node 121 through conductor 112. The current $I_A$ flows through conductor 122 to terminal 166 of potentiometer 160 and flows through the displaceable contact 168 to terminal 164 and from there to output terminal 110 via conductor 130. From the common switch terminal 176, the current $I_A$ flows through conductor 128 to terminal 146 of potentiometer 140. The current $I_A$ flows from terminal 146, through displaceable contact 148 and the end portion of resistive element portion 152 to the terminal 142 of potentiometer 140. From terminal 142 the current $I_A$ flows through the conductor 132 to terminal 164 of potentiometer 160, where the current $I_A$ then flows from terminal 164 to the output terminal 110.

The return current $I_A$ flows into output terminal 120 and therefrom through conductor 119 to node 111, through conductor 113 to input terminal 108 and from there to the terminal 724 of pickup sensor 720. The current $I_A$ flows from terminal 722 to input terminal 106 and through conductor 116, node 115 and conductor 126 to switch terminal 183. From switch terminal 183 the current $I_A$ flows through switch contact 187 to common switch terminal 178. From common switch terminal 178, the current $I_A$ flows through conductor 114 to input terminal 104 and to output terminal 714 of pickup sensor 710 to return thereto.

Due to the high resistance, 100 percent of the value of resistive element 150, no current flows from node 121 to terminal 146 of potentiometer 140 via switch contact 185, switch terminals 176, 181 and conductors 123,128. However, at positions of the displaceable contacts 148 and 168 between the intermediate position discussed with respect to FIG. 2 and the end position shown in FIGS. 6 and 7, the resistance from terminal 166 and 164 will not be as great (no longer being 100 percent of the value of the resistive element) and a component of the current $I_A$, will flow from node 121 by the path just described to terminal 146, to flow through the resistive element 150 to combine with a remaining portion of the current $I_A$, so that still the current $I_A$ is still output at terminal 110. Thus, with switch 170 switched into the B position, with the displaceable contacts 148 and 168 being at an end position, at the intermediate position or at any position between either end position and the intermediate position of the mechanical travel of displaceable contacts 148 and 168, the pickup sensors are thereby switched into the configuration where both sensors are connected in series.

Hence, in blend and configuration control 100, the switch 170 permits an immediate switching of the pickup sensors 710 and 720 to a series coupling thereof irrespective the configuration set by the potentiometers 140 and 160. The change in configuration to series is made without disturbing that setting of the potentiometers, so that the configuration can just as easily and immediately be switched back to what it had been before the switch position was changed. The potentiometers 140 and 160 provide output selection of either one of pickup sensors 710 and 720 individually at the ends of the mechanical travel of the displaceable contacts 148 and 168, the two pickup sensors 710 and 720 connected in parallel at an intermediate position of the mechanical travel of the displaceable contacts 148 and 168, or a parallel blend of the output of the two pickup sensors 710 and 720 at any position between either end position and the intermediate position of the mechanical travel of displaceable contacts 148 and 168. As the intermediate position of the mechanical travel of the displaceable contacts 148 and 168 provides the two pickup sensors 710 and 720 in parallel, each at full output, it is preferred that potentiometers 140 and 160 have a detent at that position to provide a tactile indication to the musician that the potentiometer shaft has been rotated to that position. While it is common for that intermediate position to be at approximately the midpoint of the mechanical travel of the displaceable contacts 148 and 168, it is contemplated that other positions along the mechanical travel could be designed to be the interface between the substantive resistance portion and the substantially zero resistance portion of the resistive elements, along with any correspondingly appropriate resistance taper, to define the intermediate position at such other positions.

Figure 8:
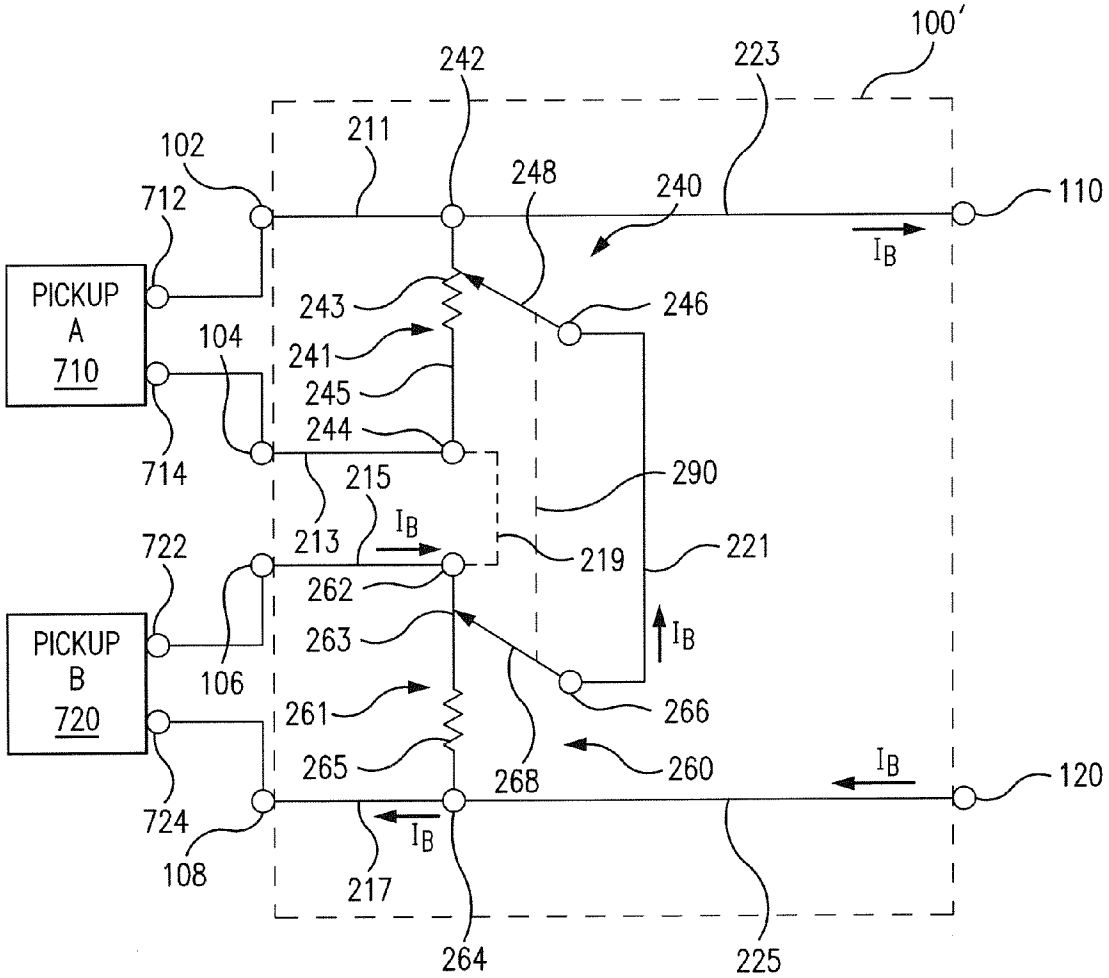
FIG. 8 is a schematic electrical diagram of another arrangement of the blend and configuration control of the present invention adjusted for a single pickup transducer configuration.
Figure 9:
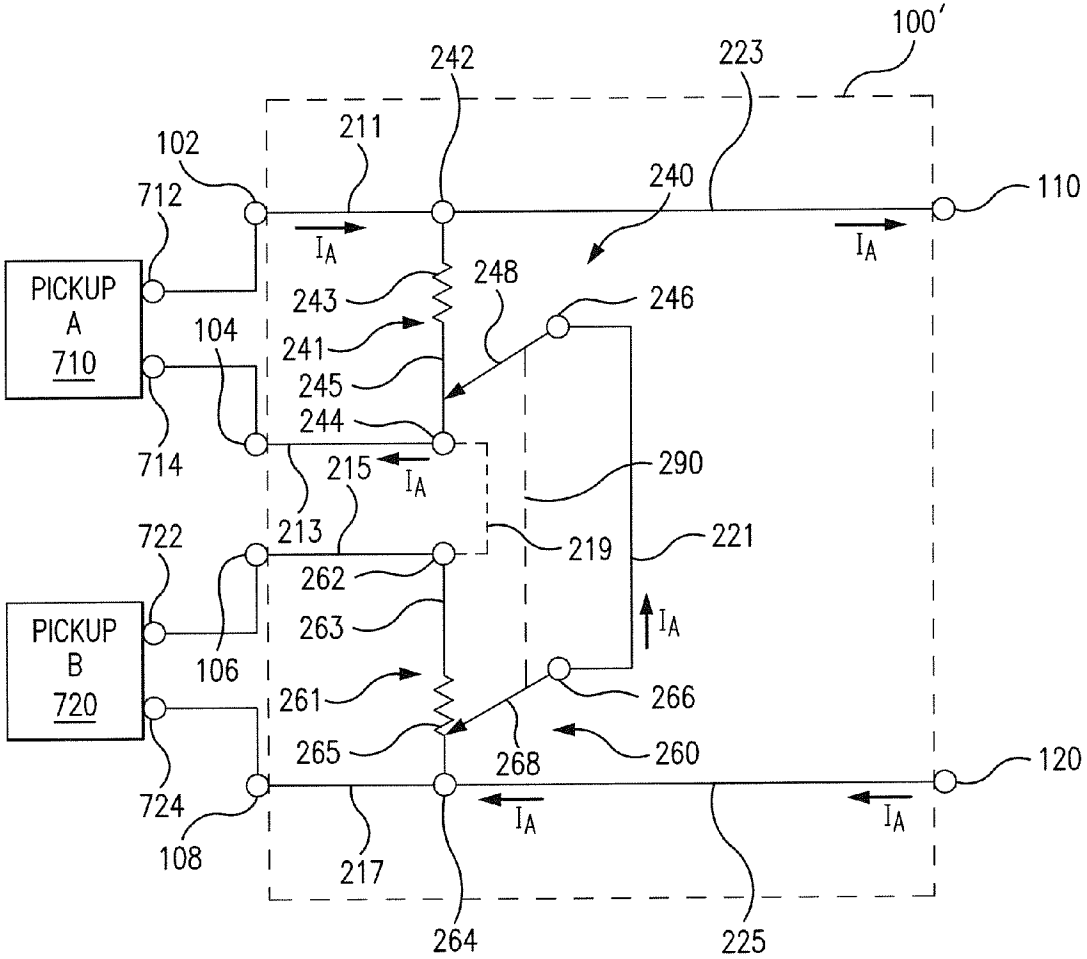
FIG. 9 is a schematic electrical diagram of the arrangement of the blend and configuration control of FIG. 8, adjusted for another single pickup transducer configuration.
Figure 10:
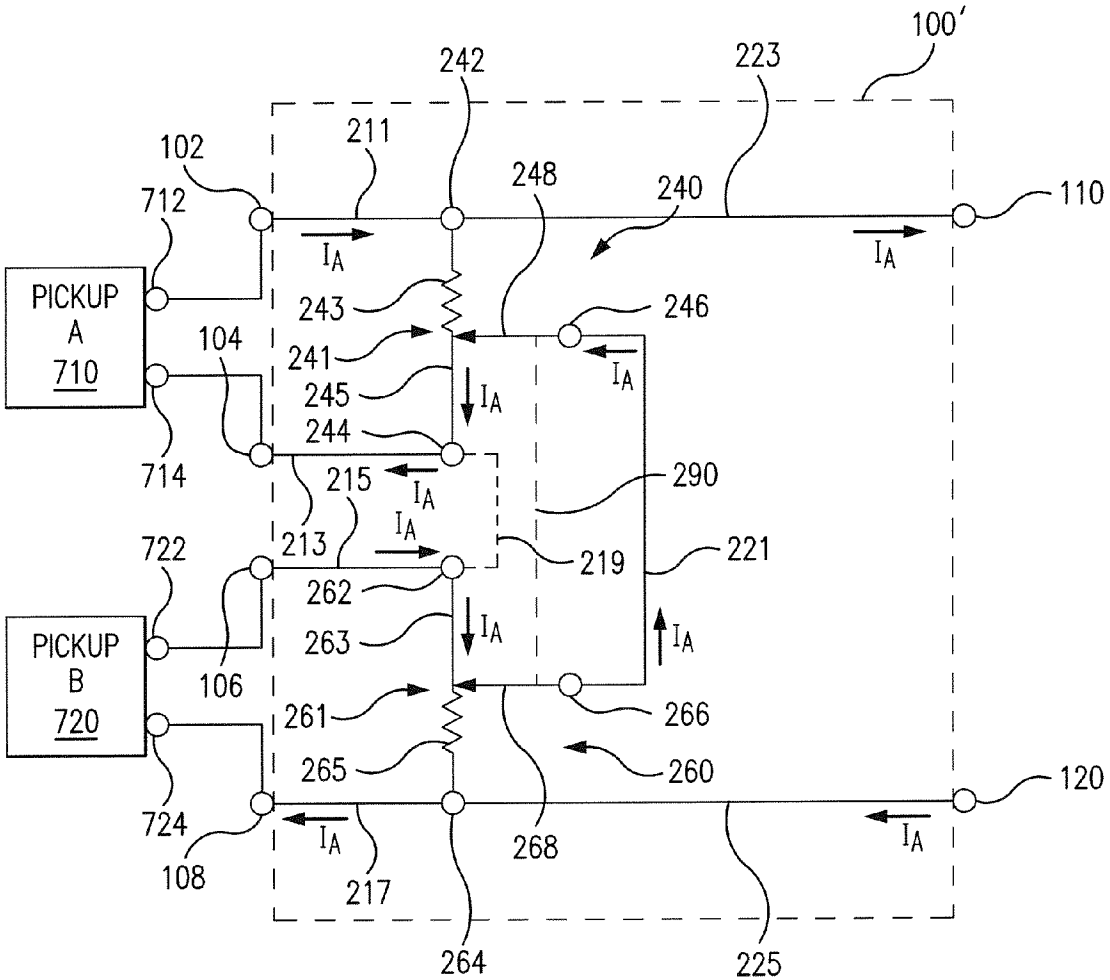
FIG. 10 is a schematic electrical diagram of another arrangement of the blend and configuration control of FIG. 8, adjusted for a series configuration of the pickup transducers.

Blend and configuration control 100', shown in FIGS. 8-10, provides a simpler arrangement wherein a pair of potentiometers 240 and 260 provide selection of the output from either of two pickup sensors 710 and 720, the series combination of the two pickup sensor outputs or a series blending thereof. As shown in FIG. 8, blend and configuration control 100' includes a pair of input terminals 102 and 104 respectively connected by appropriate leads to the output terminals 712 and 714 of pickup sensor 710. Another pair of input terminals 106 and 108 are respectively connected by appropriate leads to the output terminals 722 and 724 of pickup sensor 720. Each pair of input terminal 102, 106 and 104, 108 is correspondingly coupled across the resistive element 241, 261 of a potentiometer 240, 260.

An optional conductor 219 may be connected between potentiometer terminals 244 and 262 may be provided. Without the optional conductor 219, the terminals 244 and 262 being only respectively connected to terminals 714 and 722 of pickup sensors 710 and 720, can act as antennas for electrical noise. Whether the conductor 219 is included or not, the function of blend and configuration control 100' will be unaffected. Where the pickup sensors 710 and 720 cannot be short circuited without damage, which may be the case for those types of sensors having active electronic circuitry incorporated therein, the optional conductor 219 should not be used.

Potentiometers 240 and 260 each include a resistive element 241, 261 connected between a respective pair of terminals 242, 244 and 262, 264, and a displaceable contact 248, 268 respectively coupled to a terminal 246, 266. Potentiometers 240 and 260 are mechanically coupled together, as represented by the coupling line 290, and may be rotary or linear movement types with resistive elements 241, 261 being in the approximate range of 125 KΩ to 500 KΩ. The displaceable contacts 248 and 268 are each coupled to a respective terminal 246 and 266 that are electrically connected together by a conductor 221. In one working embodiment, potentiometers 240 and 260 were implemented as rotary type dual-gang potentiometers, which are two potentiometers combined on a common shaft, available from Bourns, Inc. of Riverside, Calif. and having the designation PDB182-GTRB with each of the resistive elements 241 and 261 being 500 KΩ.

The functioning of blend and configuration control 100' will now be described, beginning with the displaceable contacts 248 and 268 of potentiometers 240 and 260 being at one end of the mechanical travel thereof, as illustrated in FIG. 8. It should be noted that potentiometers 240 and 260 have the same structure as that of potentiometers 140 and 160, described in preceding paragraphs. Beginning from pickup sensor 720, a current $I_B$ flows from the output terminal 722 thereof to input terminal 106, and from there to potentiometer terminal 262 through the conductor 215. From terminal 262 of potentiometer 260 the current $I_B$ flows through displaceable contact 268 to terminal 266, from which the current flows through the conductor 221 to the terminal 246 of potentiometer 246 of potentiometer 240. The current $I_B$ flows from terminal 246 through displaceable contact 248 to potentiometer terminal 242. For all practical purposes, no current flows through the resistive element 241, owing to the high resistance of the restive element portion 243 with the displaceable contact 248 being at the end of the mechanical travel thereof illustrated in FIG. 8. From terminal 242, the current $I_B$ flows to output terminal 110.

The return current $I_B$ flows into output terminal 120 to terminal 264 of potentiometer 260 via conductor 225 and from there to input terminal 108 via conductor 217 to return to the pickup sensor 720 at terminal 724, which terminal is connected to input terminal 108.

At settings of potentiometer 240 and 260 where the displaceable contacts are at positions between the end of the mechanical travel thereof and the intermediate position, such provides a series blending of the outputs of pickup sensors 710 and 720. Between the intermediate position of displaceable contact 268 and the end shown in FIG. 8, the value of resistance of the corresponding resistive element portion 263 of resistive element 261 remains unchanged and is substantially zero ohms. So, there is no current flow through the restive element portion 265, which resistance value remains at 100 percent of the resistance of resistive element 261. However, as the displaceable contacts are moved toward the intermediate position, the resistance value between the terminals 246 and 244 of potentiometer 240 decreases, thereby allowing a component of the current $I_B$ to flow through a portion of the resistive element portion 243 and the zero ohm resistive element portion 245. That component of the current $I_B$ will flow through conductor 213 to terminal 714 of pickup sensor 710 via its connection to input terminal 104. That current component will flow out from output terminal 712 of pickup sensor 710 to input terminal 102, through conductor 211 to terminal 242 where it rejoins the remaining component portion of the current $I_B$ to flow to output terminal 110 through conductor 223. Therefore, it can be seen that at those settings, between the end of the mechanical travel adjacent terminals 242, 262 and the intermediate position, there is a series blend of the output of pickup sensor 710 with that of pickup sensor 720.

Turning now to FIG. 9, the functioning of blend and configuration control 100' with the displaceable contacts 248 and 268 of potentiometers 240 and 260 being at the opposing end of the mechanical travel, adjacent the potentiometer terminals 244, 264, will be examined. Looking at the pickup sensor 720, even though the output terminal 724 is connected to input terminal 108 and that terminal is connected to output terminal 120 through conductors 217 and 225 and the intervening potentiometer 264 terminal, the output terminal 722 of pickup sensor 720 coupled to potentiometer terminal 262 is isolated from the displaceable contact 268 by the high resistance of the resistance element portion 265. Thus, pickup sensor 720 contributes no current, for all practical purposes, to the output of blend and configuration control 100' at the illustrated setting.

Looking now at pickup sensor 710, the current $I_A$ flows to input terminal 102 from the output terminal 712 thereof. The current $I_A$ flows from terminal 102 to potentiometer terminal 242 and output terminal 110 through conductors 211 and 223, respectively. At the illustrated setting, no current flows from terminal 242 through the resistive element 241 due to the high resistance of resistive element portion 243. The return current $I_A$ flows into output terminal 120 to potentiometer terminal 264, and through the displaceable contact 268 to terminal 266 for continued flow to the terminal 246 of potentiometer 240 via conductor 221. The current $I_A$ then flows through displaceable contact 248 to terminal 244 and from there to return to pickup sensor 710, flowing through conductor 213 to input terminal 104 and from there to terminal 714.

As the displaceable contacts are moved toward the intermediate position from the end position illustrated in FIG. 9, the resistance value between the terminals 266 and 262 of potentiometer 260 decreases, thereby allowing a component of the current $I_A$ to flow to the terminal 724 of pickup sensor 720 from terminal 264, through conductor 217 and the connection to terminal 108. That component of the current $I_A$ flows from terminal 722 to input terminal 106, and to potentiometer terminal 262. From terminal 262 the component of current $I_A$ flows through the zero ohm resistive element portion 263 to flow through a portion of the resistive element portion 265 to the displaceable contact 268, the resistance thereto now being reduced, to rejoin the remaining component portion of the current $I_A$ to flow through the conductor 221 to flow to the terminal 714 of pickup 710, as previously described. Consequently, it can be seen that at those settings, between the end of the mechanical travel adjacent terminals 244, 264 and the intermediate position, there is a series blend of the output of pickup sensor 720 with that of pickup sensor 710.

At the intermediate position of displaceable contacts 248 and 268 of potentiometers 240 and 260, as illustrated in FIG. 10, the two pickup sensors 710 and 720 are connected a series configuration, without any intervening resistance in series with either pickup sensor. Starting at pickup sensor 710, the current $I_A$ is output from terminal 712 and flows into input terminal 102. From terminal 102 the current $I_A$ flows through conductor 211 to potentiometer terminal 242, and from there to output terminal 110. Due to the high resistance of the resistive element portion 243, no current flows therethrough to the displaceable contact 248. The return current $I_A$ flows into output terminal 120 to input terminal 10/8 through conductors 225 and 217 and the intervening potentiometer terminal 264. Due to the high resistance of the resistive element portion 265, no current flows therethrough to the displaceable contact 268. The current $I_A$ flows to the output terminal 724 of pickup sensor 720 from input terminal 108, and flows from output terminal 722 thereof to input terminal 106. From input terminal 106, the current $I_A$ flows to potentiometer terminal 262, through zero ohm resistive element portion 263 to displaceable contact 268 and to terminal 266 therefrom. The current $I_A$ then flows through conductor 221 to terminal 246, from which the current flows through displaceable contact 248 and zero ohm resistive element portion 245 to terminal 244 and then to input terminal 104 via conductor 213. From terminal 104, the current $I_A$ flows back to the pickup sensor 710, flowing to output terminal 714 from input terminal 104. Thus, at the intermediate position of displaceable contacts 248 and 268 of potentiometers 240 and 260 it can be seen that the two pickup sensors are connected in series between the output terminals 110 and 120 of blend and configuration control 100'. Even with the intermediate position of the displaceable contacts being at approximately the midpoint of the mechanical travel of the displaceable contacts, blend and configuration control 100' includes a detent at the intermediate position to provide a tactile indication of that position, as an aid to a musician playing the instrument 700.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is claimed is:

1. A blend and configuration control for a string instrument having a pair of pickup transducers, comprising:

a switch having multiple poles coupled to the pair of pickup transducers; and a pair of potentiometers each being coupled to said switch, each of said pair of potentiometers having a displaceable contact, said pair of potentiometers being mechanically coupled to one another for concurrent mechanical travel of said displaceable contacts thereof; responsive to said switch being in a first position:

said pair of potentiometers providing selective operative coupling of (a) one of the pair of pickup transducers to said pair of output terminals exclusive of the other of the pair of pickup transducers, or (b) the other of said pair of pickup transducers to said pair of output terminals exclusive of the one pickup transducer, or (c) the pair of pickup transducers connected in parallel, one with respect to the other, to said output terminals, the output of each of the pair of pickup transducers being variably blended responsive to a position of said displaceable contacts exclusive of opposing ends of said mechanical travel;

responsive to said switch being in a second position:

the pair of pickup transducers being connected in series relationship irrespective of a position of said displaceable contacts of pair of potentiometers.

2. The blend and configuration control for a string instrument as recited in claim 1, where said displaceable contacts of said pair of potentiometers are each electrically connected to said switch.

3. The blend and configuration control for a string instrument as recited in claim 1, where each of said pair potentiometers has a substantial resistance between an intermediate position and one of end of said concurrent mechanical travel of said displaceable contacts and an insignificant resistance between said intermediate position and another end of said concurrent mechanical travel of said displaceable contacts.

4. The blend and configuration control for a string instrument as recited in claim 3, where said substantial resistance of a first of said pair of potentiometers is disposed between said intermediate position and a first end position of said displaceable contact mechanical travel thereof, and said substantial resistance of a second of said pair of potentiometers being disposed between said intermediate position and an opposing second end position of said displaceable contact mechanical travel thereof.

5. The blend and configuration control for a string instrument as recited in claim 4, where a second end position of said displaceable contact mechanical travel of said first potentiometer and a first end position of said displaceable contact mechanical travel of said second potentiometer are coupled in common to one of said pair of output terminals.

6. The blend and configuration control for a string instrument as recited in claim 1, where the pair of pickup transducers each has a pair of output terminals respectively coupled to a different pole of said switch.

7. The blend and configuration control for a string instrument as recited in claim 1, where said switch is a double pole, double throw type switch.

8. The blend and configuration control for a string instrument as recited in claim 3, where each of said pair of potentiometers has a detent at said intermediate position of said concurrent mechanical travel to provide a tactile indication thereof.

9. A blend and configuration control for a string instrument having a pair of pickup transducers, comprising a pair of potentiometers each having a displaceable contact, said displaceable contacts being electrically connected one to another, said pair of potentiometers being mechanically coupled to one another for concurrent mechanical travel of said displaceable contacts thereof, said pair of potentiometers being coupled to a pair of output terminals and each of said potentiometers being electrically connected to a respective one of the pair of pickup transducers, responsive to a position of said displaceable contacts, said pair of potentiometers providing selective operative coupling of (a) only one of the pair of pickup transducers to said output terminals, or (b) only the other of the pair of pickup transducers to said output terminals, or (c) the pair of pickup transducers coupled in series to said output terminals, or (d) a blend of the output of the pair of pickup transducers coupled in series.

10. The blend and configuration control for a string instrument as recited in claim 9, where selective operative coupling of (a) is at a first end of a mechanical travel of said displaceable contacts.

11. The blend and configuration control for a string instrument as recited in claim 10, where selective operative coupling of (b) is at a second end of said mechanical travel of said displaceable contacts.

12. The blend and configuration control for a string instrument as recited in claim 11, where selective operative coupling of (c) is at an intermediate position of said mechanical travel of said displaceable contacts.

13. The blend and configuration control for a string instrument as recited in claim 12, where selective operative coupling of (d) is at a range of positions between said first end and said intermediate position of said mechanical travel of said displaceable contacts and at a range of positions between said intermediate position and said second end of said mechanical travel.

14. The blend and configuration control for a string instrument as recited in claim 11, where selective operative coupling of (c) is at a central position of said mechanical travel of said displaceable contacts.

15. The blend and configuration control for a string instrument as recited in claim 9, where each of said pair potentiometers has a substantial resistance between an intermediate position and one of end of said concurrent mechanical travel of said displaceable contacts and an insignificant resistance between said intermediate position and another end of said concurrent mechanical travel of said displaceable contacts.

16. The blend and configuration control for a string instrument as recited in claim 9, where each of said pair of potentiometers has a detent at said intermediate position of said concurrent mechanical travel to provide a tactile indication thereof.

17. The blend and configuration control for a string instrument as recited in claim 9, where each of said pair potentiometers has a substantial resistance between an intermediate position and one of end of said concurrent mechanical travel of said displaceable contacts and an insignificant resistance between said intermediate position and another end of said concurrent mechanical travel of said displaceable contacts, said substantial resistance of a first of said pair of potentiometers being disposed between said intermediate position and a first end position of said displaceable contact mechanical travel thereof, and said substantial resistance of a second of said pair of potentiometers being disposed between said intermediate position and an opposing second end position of said displaceable contact mechanical travel thereof.

* * * * *